US005992767A

United States Patent [19]

Phillips et al.

[11] Patent Number: 5,992,767

[45] Date of Patent: Nov. 30, 1999

[54] INJECTOR

[75] Inventors: Ronald Phillips, Hayes; Anthony John Williams, Isleworth, both of United Kingdom

[73] Assignee: Lucas Industries plc, United Kingdom

[21] Appl. No.: 09/004,987

[22] Filed: Jan. 9, 1998

[30] Foreign Application Priority Data

Jan. 11, 1997 [GB] United Kingdom ..... 9700491

[51] Int. Cl.[6] ..... F02M 47/02

[52] U.S. Cl. ..... 239/533.8

[58] Field of Search ..... 239/533.8, 88, 239/93

[56] References Cited

U.S. PATENT DOCUMENTS

| | | | |
|---|---|---|---|
| 2,243,011 | 5/1941 | L'Orange | 239/533.8 X |
| 3,738,576 | 6/1973 | O'Neill | 239/533.8 |
| 3,797,753 | 3/1974 | Fenne et al. | 239/533.8 |
| 4,225,088 | 9/1980 | Kulke et al. | 239/533.8 X |
| 4,566,635 | 1/1986 | Trachte | 239/533.8 |
| 4,635,854 | 1/1987 | Ishibashi | 239/533.8 |
| 4,962,887 | 10/1990 | Matsuoka | 239/533.8 X |
| 5,282,574 | 2/1994 | Koch . | |

FOREIGN PATENT DOCUMENTS

| | | |
|---|---|---|
| 0 686 763 | 12/1995 | European Pat. Off. . |
| 0 726 390 | 8/1996 | European Pat. Off. . |
| 4 041 878 | 7/1991 | Germany . |
| 4 115 477 | 11/1991 | Germany . |
| 59-173171 | 8/1984 | Japan . |

*Primary Examiner*—Kevin Weldon
*Attorney, Agent, or Firm*—Andrus, Sceales, Starke & Sawall

[57] ABSTRACT

An injector is disclosed which comprises a valve needle engageable with a seating. A spring urges the needle towards its seating, the spring engaging a spring abutment. A pressure backing member positioned within the injector is slidable relative to the spring abutment under the action of the pressure of fuel applied thereto. The pressure backing member is engageable with a surface associate with the needle to urge the needle towards its seating. The slidable pressure backing member reduces the pressure in the pumping chamber both prior to and after termination of the injection process. Also, the backing member maintains the pressure in a fuel supply passage of a low level to enhance the efficiency of the injector.

7 Claims, 3 Drawing Sheets

INJECTOR

BACKGROUND OF THE INVENTION

This invention relates to an injector for use in supplying fuel under pressure to a cylinder of an associated engine.

FIG. 1 illustrates a known fuel injector arrangement which comprises a fuel pump 1 including a plunger 2 which is reciprocable within a bore 3 under the action of a cam arrangement 4. A return spring 5 biases the plunger 2 out of the bore 3. The bore 3 communicates with a port of a spill valve 6, the other port of which communicates through a non-return valve 7 with a source of fuel.

The arrangement further comprises a two-stage lift injector 8 which includes a needle biased into engagement with a seating, the needle including surfaces oriented such that the application of fuel under pressure thereto tends to lift the needle from its seating. These surfaces are supplied with fuel through a supply line 9 from the bore 3 of the pump 1.

The needle carries a spring abutment 10 which engages a first spring 11, the other end of which engages a pressure backing member 12. The surface of the member 12 facing away from the spring 11 is exposed, through a passage 13, to the pressure at the said other port of the spill valve 6. A second spring 14 is located such that after a predetermined amount of movement of the needle away from its seating has occurred, further movement is opposed by both the first spring 11 and the second spring 14, thus a greater fuel pressure must be applied to the needle in order for such further movement to take place.

In use, in the position illustrated in FIG. 1, the bore 3 is charged with fuel, and the plunger is moving inwardly. The spill valve 6 is open, thus the inward movement of the plunger 2 results in fuel being displaced through the spill valve 6 and passage 13 to the member 12. Once the pressure of the fuel exceeds a predetermined pressure, the member 12 lifts against the action of the first spring 11, such movement permitting the fuel to escape to the spring chamber 15 and from there through a passage 16 to a low pressure reservoir. The fuel pressure necessary to move the member 12 is lower than that required to move the needle, thus whilst the spill valve 6 is open, injection does not commence. In order to commence injection, the spill valve 6 is closed. The fuel pressure applied to the member 12 falls, and the member 12 moves to its rest position under the action of the first spring 11. Continued inward movement of the plunger 2 pressurizes the fuel in the bore 3, thus the fuel pressure applied to the injector needle increases, and the increase is sufficient to result in movement of the needle from its seating against the action of the first spring 11 and subsequently against the action of both springs 11, 14. The movement of the needle causes a rod 10*a* carried by the spring abutment 10 to move into engagement with the member 12.

To terminate injection, the spill valve 6 is opened, thus permitting fuel at high pressure to be supplied to the passage 13. The pressure of fuel applied to the member 12 causes the member 12 and rod 10*a* to move which assists the spring 14 in moving the needle towards its seating against the action of the reduced pressure applied to the needle, and also permits fuel to flow to the passage 16. Continued inward movement of the plunger 2 therefore displaces fuel through the spill valve 6 to the low pressure reservoir. Once the plunger has completed its inward movement, the plunger 2 is withdrawn from the bore under the action of the spring 5, such movement drawing fuel through the non-return valve 7 and spill valve 6 to the bore 3.

In the arrangement illustrated in FIG. 1, the member is provided with an opening providing a restricted communication between the passage 13 and spring chamber 15, but this opening may be omitted.

It will be appreciated that the pressure which must be generated prior to injection to cause movement of the member 12 against the action of the first spring 11 is relatively high. It is an object of the invention to provide an arrangement in which this pressure is reduced.

SUMMARY OF THE INVENTION

According to the present invention there is provided an injector comprising a valve needle biased into engagement with a seating by a spring arranged to engage a spring abutment, and a pressure backing member slidable with respect to the spring abutment under the action of fuel under pressure applied to the pressure backing member, in use, and engageable with a surface associated with the valve needle to urge the valve needle towards its seating.

The provision of an arrangement in which the pressure backing member is separate from the spring abutment enables the provision of an arrangement in which during pumping prior to commencement of injection, movement of the pressure backing member can occur without moving the spring abutment, hence such movement is unaffected by the spring force acting on the spring abutment.

Conveniently, the spring abutment remains stationary throughout the range of movement of the pressure backing member.

BRIEF DESCRIPTION OF THE DRAWINGS

The invention will further be described, by way of example, with reference to the accompanying drawings, in which.

Figure 1:
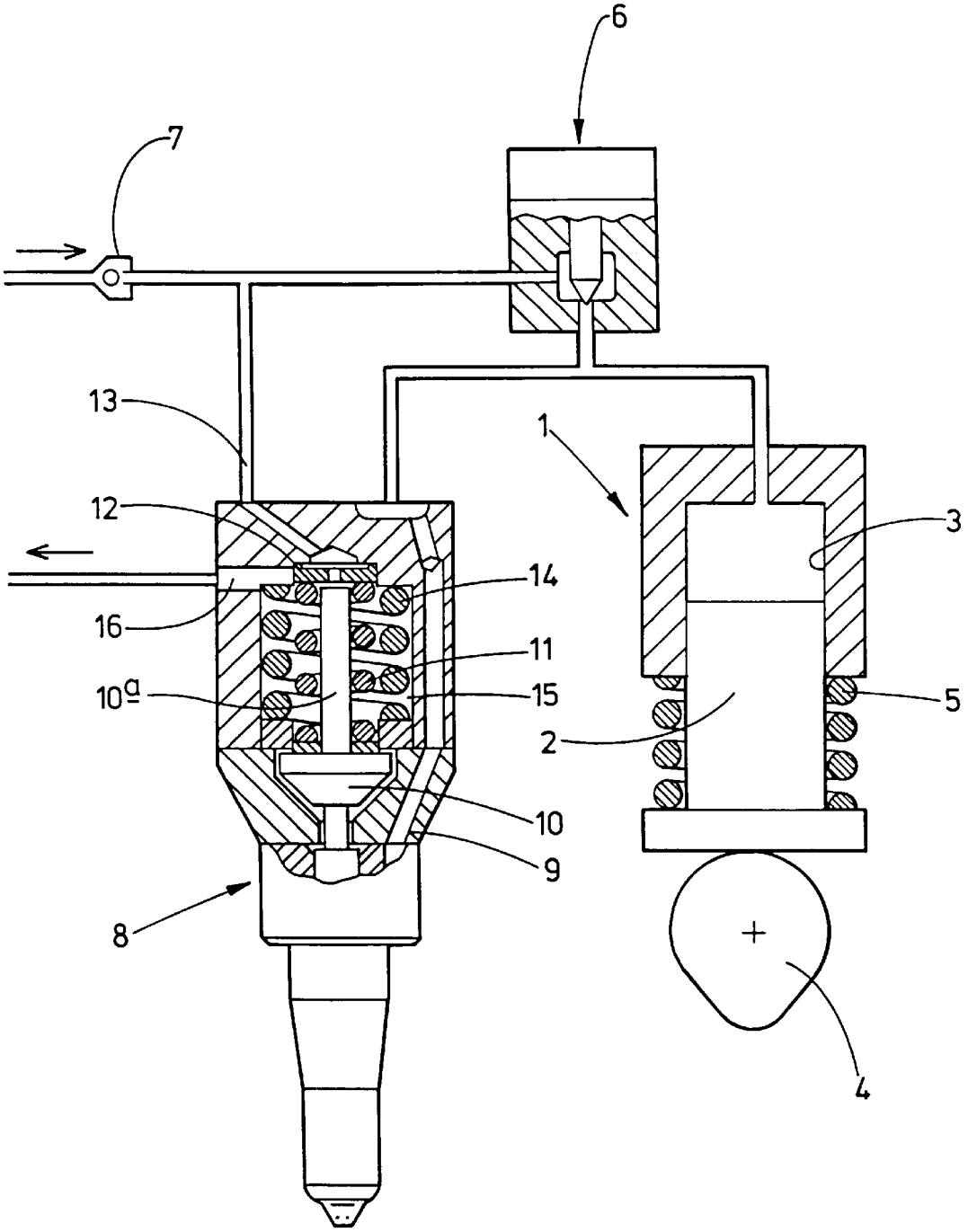
FIG 1 (PRIOR ART)
FIG. 1 is a diagrammatic view of a known arrangement.
Figure 2:
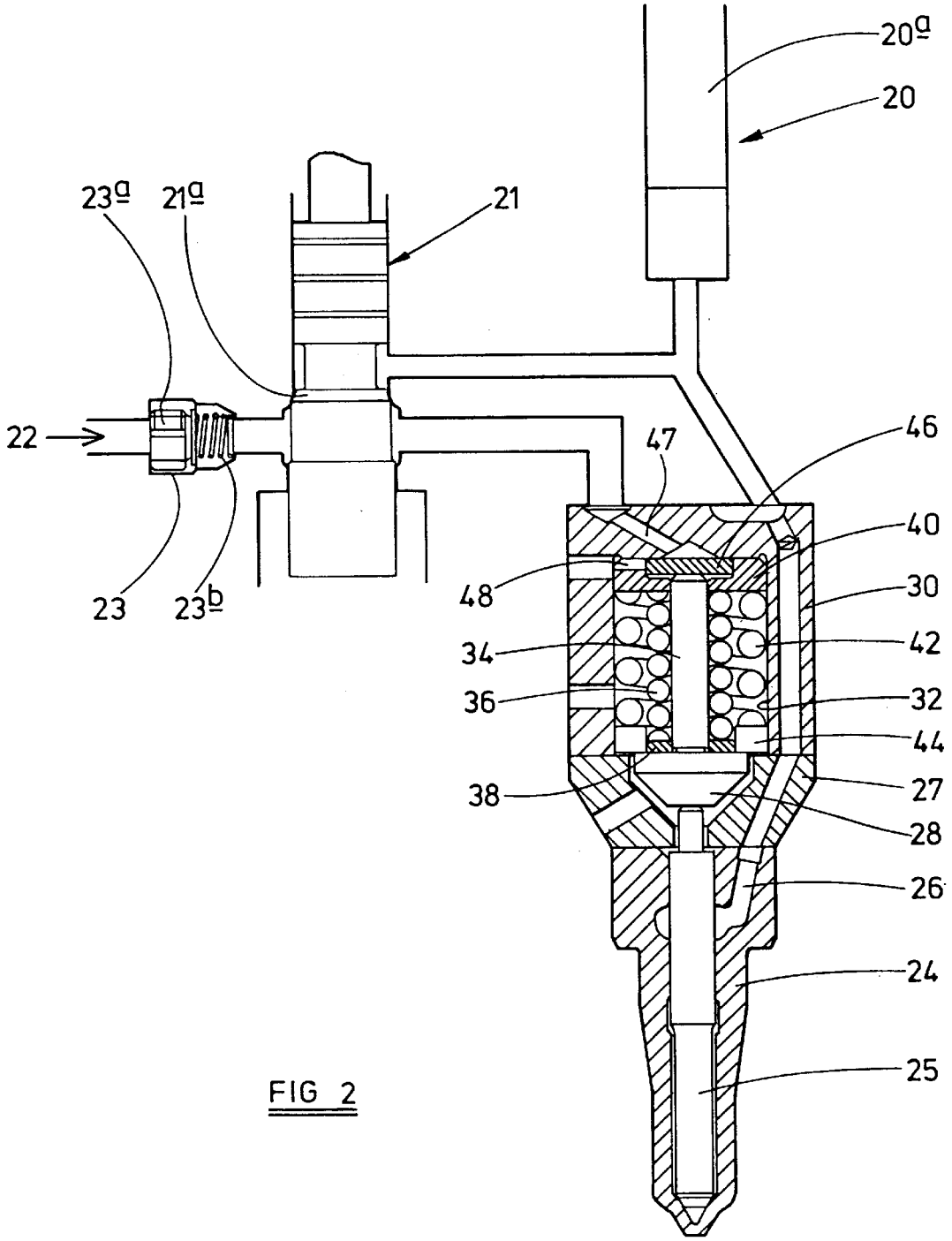
FIG. 2 is a diagrammatic cross-sectional view of an injector in accordance with a first embodiment of the invention.

The injector illustrated in FIG. 2 is intended to form part of a fuel system including a pump 20 and a spill valve 21, the pump 20 being arranged to be supplied with fuel through the spill valve 21 from an inlet 22, a one way valve 23 being located between the inlet 22 and the spill valve 21.

DETAILED DESCRIPTION OF THE DRAWINGS

The injector comprises a nozzle body 24 having a blind bore provided therein, a valve needle 25 being slidable within the bore of the nozzle body 24. The valve needle 25 is engageable with a seating defined adjacent the blind end of the bore, the nozzle body 24 including outlet apertures which communicate with the blind bore downstream of the seating. It will be appreciated, therefore, that engagement of the valve needle 20 with the seating controls communication between the bore and the outlet apertures. The bore communicates through a supply passage 26 with the outlet of the pump 20.

The nozzle body 24 abuts a distance piece 27 which includes a through bore, a projection extending from an end of the valve needle 25 projecting into the through bore of the distance piece 27. A spring abutment 28 engages the end of the projection.

A nozzle holder 30 abuts the distance piece 27, the nozzle holder 30 including a bore of relatively large diameter which defines a spring chamber 32. An extension rod 34 abuts the spring abutment 28 and extends within the spring chamber 32, the extension rod 34 forming a guide for a first spring 36 which is engaged between a shim 38 carried by the spring abutment 28, and a second spring abutment 40 which abuts the end of the spring chamber 28 remote from the distance piece 27. A second spring 42 is engaged between the second spring abutment 40 and a shim 44 which, in the position illustrated in FIG. 2, abuts a step defined by an end of the distance piece 27. The dimensions of the spring abutment 28 are such that, upon movement of the valve needle 25 away from its seating, the spring abutment 28 is engageable with the shim 44 to compress the second spring 42.

The face of the second spring abutment 40 facing away from the spring abutment 28 is provided with a recess within which a pressure backing member 46 is slidable, the pressure backing member 46 being engageable with the extension rod 34 which extends through an opening provided in the second spring abutment member 40. The pressure backing member 46 is located such that, in use, fuel at high pressure can be applied to the pressure backing member 46 through a passage 47 to move the pressure backing member 46 towards the seating, and hence result in movement of the valve needle 25 towards its seating. The second spring abutment 40 includes a restricted channel 48 whereby fuel supplied to the injector from the spill valve 21 can escape to a low pressure drain. Passages are also provided in the injector to permit fuel to escape from the spring chamber 32 and the chamber within which the spring abutment 28 is located in order to permit fuel therein to escape to a low pressure drain.

In use, in the position shown in FIG. 2, the spill valve 21 is closed, the spill valve member 21*a* thereof engaging its seating to prevent fuel from the pump 20 being supplied to the passage 47 and pressure backing member 46, and the plunger 20*a* of the pump is moving in an inward direction to displace fuel from the pump 20 and hence result in fuel being supplied at high pressure to the supply line 26. The fuel supplied to the supply line 26 is at a sufficiently high pressure that a force is applied to the valve needle 25 resulting in the valve needle 25 being lifted away from its seating against the action of the first and second springs 36, 42. As illustrated, the valve needle 25 occupies a fully lifted position in which the extension rod 34 abuts the pressure backing member 46.

In order to terminate injection, the spill valve 21 is actuated to move the spill valve member 21*a* away from its seating thus permitting fuel at high pressure from the pump 20 to be applied to the pressure backing member 46. It will be appreciated that the fuel pressure applied to the pressure backing member 46 is substantially equal to that applied to the angled thrust surfaces of the valve needle 25, the difference in area of the pressure backing member 46 and thrust surfaces of the valve needle 25, together with the action of the springs 36, 42, being such that movement of the pressure backing member 46 and movement of the valve needle 25 occurs, the valve needle 25 moving into engagement with its seating.

Movement of the pressure backing member 46 away from the position shown in FIG. 2 permits fuel to flow through the restricted passage 48 to the low pressure drain. It will be appreciated that as the passage 48 is restricted, a sufficiently high pressure is applied to the pressure backing member 46 to result in movement of the valve needle 25 as described hereinbefore. Once the needle 25 occupies its closed position in which it engages its seating, further movement of the pressure backing member 46 in this direction will not occur.

Continued inward movement of the pumping plunger results in fuel continuing to be displaced through the spill valve 21 to the pressure backing member 46 and through the restricted passage 48 to the low pressure drain. Subsequently, the plunger will complete inward movement and will commence outward movement under the action of a spring (not shown). Such outward movement of the pumping plunger results in fuel being drawn through the spill valve 21 from the inlet 22. A restricted flow of fuel may also occur through the restricted passage 48, but it will be appreciated that as the cross sectional area of the restricted passage 48 is relatively low, the quantity of fuel supplied through this passage is insufficient to fill the pumping chamber of the pump 20, particularly at high speeds. The outward movement of the pumping plunger results in a pressure difference across the one way valve 23 sufficient to lift the valve member 23*a* thereof away from its seating against the action of a spring 23*b* and hence permit fuel to flow from the inlet 22 through the spill valve 21 to the pumping plunger 20*a*.

Such filling of the pumping chamber continues until the plunger 20*a* reaches its outermost position whereafter inward movement of the plunger 20*a* occurs under the action of a cam arrangement (not shown) such inward movement results in fuel being displaced through the spill valve 21 to be applied to the pressure backing member 46. As the pressure backing member 46 is not spring biased, unlike the known arrangement, the supply of fuel to the pressure backing member 46 causes the member 46 to occupy a position in which fuel is able to flow through the restricted passage 48 to the low pressure drain, thus the fuel pressure generated by the inward movement of the plunger is relatively low.

Subsequently, the spill valve 21 is closed whereafter the flow of fuel to the low pressure drain terminates, and continued inward movement of the plunger results in the fuel pressure applied to the injector increasing. As described hereinbefore, the fuel pressure applied to the injector by the pump 20 results in a force being applied to the valve needle 25 against the action of the springs 36, 42. When the valve needle 25 engages its seating, the spring abutment 28 is spaced from the shim 44, thus initially the fuel pressure acting on the valve needle 25 acts only against the action of the first spring 36. It will be appreciated that a first, relatively low pressure will be sufficient to lift the valve needle 25 away from its seating, such movement of the valve member 22 continuing until the spring abutment 28 engages the shim 44. Further movement of the valve needle 25 acts against both the first spring 36 and the second spring 42 thus requiring a higher fuel pressure to be applied to the valve needle 25. Movement of the valve needle 25 therefore terminates until a sufficiently high pressure is applied to the angled thrust surfaces thereof generated by further inward movement of the plunger. Eventually, a sufficiently high pressure will be reached to permit continued movement of the valve needle to the position shown in FIG. 2. The needle 25 remains in the position shown in FIG. 2 until termination of injection is required which is achieved in the manner described hereinbefore.

Figure 3:
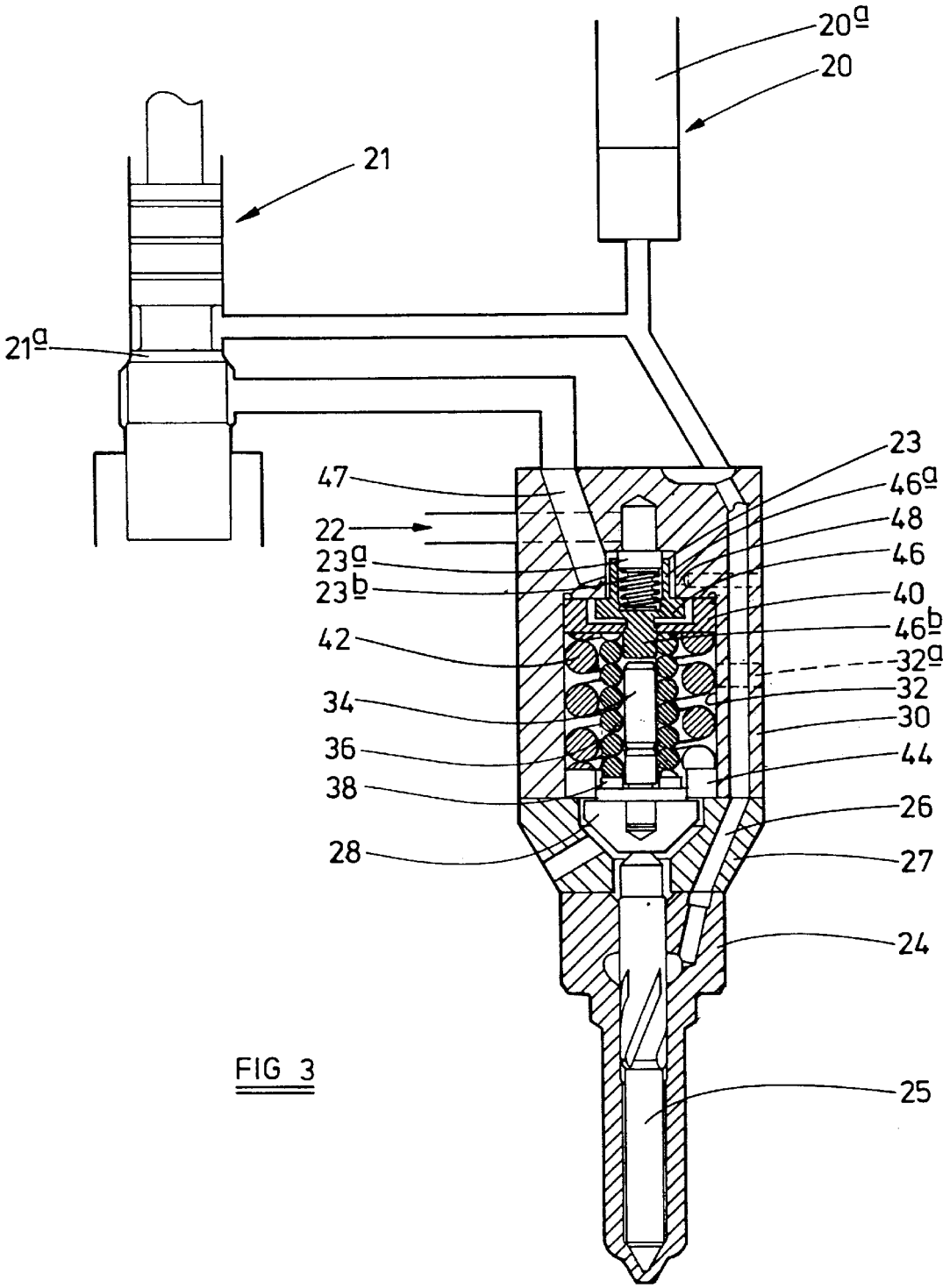
FIG. 3 is a view similar to FIG. 2 of an alternative arrangement.

The arrangement illustrated in FIG. 3 is similar to that of FIG. 2 but rather than locating the inlet 22 and one way valve 23 so as to communicate directly with the spill valve 21, the one way valve 23 forms part of the injector assembly, the valve member 23*a* of the one way valve being biased into engagement with a seating by a spring 23*b* engaged between the valve member 23*a* and the pressure backing member 46. As illustrated in this embodiment, the pressure backing member 46 includes an upwardly extending wall 46*a* which defines a guide for the valve member 23*a*. The pressure backing member 46 further includes a downwardly extending projection 46*b* which extends with clearance, through the opening of the second spring abutment and engages the extension rod 34.

The pressure backing member 46 is engageable with a seating, thus the position of the pressure backing member 46 controls communication between the passage 47 and the spring chamber 32. As shown in FIG. 3, the passage 32*a* communicates with the spring chamber 32, this passage communicating with a low pressure drain, in use.

Upstream of the seating, the passage 47 communicates with the low pressure drain through a restricted passage 48. It will be appreciated that this communication is constant.

Operation of this embodiment is similar to that described hereinbefore with the exception that during filling of the pump 20, the valve element 23*a* moves against the action of the spring 23*b*, thus exerting a minor additional force on the valve needle 25. As the valve needle 25 engages the seating during this part of the injection cycle, the additional force exerted on the needle 25 does not have a significant effect.

In addition, at the termination of injection, the pressure backing member 46 is initially seated thus the fuel pressure acts upon only the exposed upper surface thereof. Subsequently, once the pressure backing member 46 has lifted from its seating, fuel is able to escape to the low pressure drain through the spring chamber 32. As the pressure backing member 46 is not spring biased towards its seating, the pressure maintained in the passage 47 is low.

The arrangement of FIG. 3 could be modified to omit the restricted passage 48, instead providing a restricted passage in the second spring abutment member 40 similar to that of the FIG. 2 arrangement to which fuel is able to flow when the pressure backing member 46 is lifted from its seating. In such a modification, the pressure backing member 46 should be a close fit within the second spring abutment member 40.

It will be appreciated that both of these embodiments have the advantages that as the pressure backing member 46 is not spring biased into engagement with a seating by the spring (s) used to control the position of the valve needle, the pressure within the pumping chamber of the pump 20 prior to and after termination of injection is reduced. As a result, parasitic power losses are reduced, and the force required to close the spill valve is reduced. In addition, movement of the pressure backing member 46 together with the action of both springs rather than only one of the springs result in movement of the valve needle into engagement with its seating occurring whilst the pressure applied to the valve needle 25 is greater than would otherwise be the case. Also, as the pressure backing member does not move against the action of a spring load, termination of injection is improved.

We claim:

1. A fuel system comprising an injector and a spill valve, the injector comprising a valve needle biased into engagement with a seating by a first spring arranged to engage a spring abutment, and a pressure backing member slidable with respect to the spring abutment under the action of fuel under pressure applied to the pressure backing member, in use, and engageable with a surface associated with the valve needle to urge the valve needle towards its seating, the spill valve being operable to relieve the fuel pressure applied to the seating of the injector, permitting fuel to flow to a low pressure fuel reservoir, and to apply fuel under pressure to the pressure backing member to the injector.

2. A fuel system as claimed in claim 1, wherein the pressure backing member is moveable through a range of movement, the spring abutment remaining stationary throughout the range of movement of the pressure backing member.

3. A fuel system as claimed in claim 1, further comprising a rod arranged to extend through an opening provided in the spring abutment, the rod being engageable with the pressure backing member and defining the said surface associated with the valve needle.

4. A fuel system as claimed in claim 1, wherein the pressure backing member includes a projection extending through an opening provided in the spring abutment and engageable with the said surface associated with the valve needle.

5. A fuel system as claimed in claim 1, further comprising an inlet non-return valve including a valve member biased towards a seating by a valve spring, the valve spring engaging the pressure backing member.

6. A fuel system as claimed in claim 1, further comprising a seating with which the pressure backing member is engageable to control fuel flow towards a spring chamber within which the first spring is located.

7. A fuel system as claimed in claim 1, further comprising a second spring engaging the spring abutment, the second spring assisting the first spring in urging the valve needle towards its seating when the valve needle is lifted from its seating beyond a predetermined position.

* * * * *